US010443900B2

(12) United States Patent
Kujak et al.

(10) Patent No.: US 10,443,900 B2
(45) Date of Patent: Oct. 15, 2019

(54) HEAT PUMP

(71) Applicant: TRANE INTERNATIONAL INC., Davidson, NC (US)

(72) Inventors: Stephen A. Kujak, Onalaska, WI (US); Kenneth J. Schultz, Onalaska, WI (US); Ronald Maurice Cosby, II, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 15 days.

(21) Appl. No.: 15/311,777

(22) PCT Filed: Jan. 8, 2016

(86) PCT No.: PCT/US2016/012626

§ 371 (c)(1),
(2) Date: Nov. 16, 2016

(87) PCT Pub. No.: WO2016/112275

PCT Pub. Date: Jul. 14, 2016

(65) Prior Publication Data

US 2017/0248349 A1 Aug. 31, 2017

Related U.S. Application Data

(60) Provisional application No. 62/101,546, filed on Jan. 9, 2015.

(51) Int. Cl.
*F25B 45/00* (2006.01)
*F25B 9/10* (2006.01)
(Continued)

(52) U.S. Cl.
CPC ..... *F25B 9/10* (2013.01); *F25B 5/04* (2013.01); *F25B 7/00* (2013.01); *F25B 9/002* (2013.01);
(Continued)

(58) Field of Classification Search
CPC .. F25B 9/10; F25B 9/002; F25B 9/008; F25B 45/00; F25B 13/00; F25B 2600/2501;
(Continued)

(56) References Cited

U.S. PATENT DOCUMENTS 4,149,389 A 4/1979 Hayes et al.
4,165,037 A * 8/1979 McCarson ..... F24F 3/001 237/1 R
(Continued)

FOREIGN PATENT DOCUMENTS

EP 3128262 A1 * 2/2017 ..... F25B 5/04
WO 03-083382 10/2003
WO WO-2016185568 A1 * 11/2016 ..... F25B 5/02

OTHER PUBLICATIONS

Sachdeva et al. (2014). Performance Study of Cascade Refrigeration System Using Alternative Refrigerants . International Journal of Mechanical and Mechatronics Engineering, 8(3), 522-528. Retrieved from https://waset.org/publications/9997619/performance-study-of-cascade-refrigeration-system-using-alternative-refrigerants.*
(Continued)

*Primary Examiner* — Cassey D Bauer
*Assistant Examiner* — Miguel A Diaz
(74) *Attorney, Agent, or Firm* — Hamre, Schumann, Mueller & Larson, P.C.

(57) ABSTRACT

Embodiments as disclosed herein are directed to a heat pump that employs at least two different refrigerants, each of which is optimized for either a cooling operation mode or a heating operation mode. The embodiments as disclosed herein can help increase the capacity and/or efficiency of a heat pump in both the cooling operation mode and the heating operation mode. In addition, the embodiments as disclosed herein may also eliminate the need for a ground source in a relatively low ambient temperature environment.

13 Claims, 3 Drawing Sheets

(51) Int. Cl.

| | |
|---|---|
| ***F25B 13/00*** | (2006.01) |
| ***F25B 5/04*** | (2006.01) |
| ***F25B 7/00*** | (2006.01) |
| ***F25B 41/04*** | (2006.01) |
| ***F25B 9/00*** | (2006.01) |
| *F24H 4/02* | (2006.01) |

(52) U.S. Cl.
CPC ..... *F25B 9/008* (2013.01); *F25B 13/00* (2013.01); *F25B 45/00* (2013.01); *F24H 4/02* (2013.01); *F25B 41/043* (2013.01); *F25B 2313/0252* (2013.01); *F25B 2313/0253* (2013.01); *F25B 2339/047* (2013.01); *F25B 2400/0403* (2013.01); *F25B 2500/31* (2013.01); *F25B 2600/2501* (2013.01)

(58) Field of Classification Search
CPC ..... F25B 2500/02; F25B 2500/31; F25B 2400/0403; F25B 2339/047; F25B 2313/0253; F25B 2313/0214; F25B 2313/0215; F25B 2313/0252; F25B 2313/02523; F25B 2313/0254; F25B 2313/02541; F25B 2313/02543; F25B 2313/02531; F25B 2313/02533; F25B 7/00; F25B 25/00; F25B 25/005; F25B 41/04; F25B 41/043; F25B 5/00; F25B 5/02; F25B 5/04
See application file for complete search history.

(56) References Cited

U.S. PATENT DOCUMENTS

| | | | | |
|---|---|---|---|---|
| 5,467,812 | A | 11/1995 | Dean et al. | |
| 2008/0302113 | A1 | 12/2008 | Yin et al. | |
| 2009/0288437 | A1* | 11/2009 | Matsuoka | F24F 3/06 62/238.6 |
| 2009/0293507 | A1* | 12/2009 | Narayanamurthy | F24F 5/0017 62/59 |
| 2010/0043475 | A1* | 2/2010 | Taras | F25B 1/10 62/331 |
| 2010/0077788 | A1* | 4/2010 | Lewis | F25B 7/00 62/324.6 |
| 2010/0147006 | A1* | 6/2010 | Taras | F25B 7/00 62/335 |
| 2011/0120158 | A1* | 5/2011 | Choi | F25B 7/00 62/113 |
| 2011/0120168 | A1* | 5/2011 | Choi | F25B 7/00 62/324.6 |
| 2012/0186284 | A1* | 7/2012 | Choi | F25B 7/00 62/115 |
| 2012/0312045 | A1* | 12/2012 | Kim | F24D 17/02 62/238.6 |
| 2013/0180276 | A1* | 7/2013 | Choi | F25B 7/00 62/190 |
| 2013/0219945 | A1* | 8/2013 | Koge | F25B 13/00 62/324.6 |
| 2013/0306301 | A1* | 11/2013 | Tamaki | F25B 30/00 165/287 |
| 2014/0013790 | A1* | 1/2014 | Asari | F25B 1/00 62/335 |
| 2014/0083122 | A1* | 3/2014 | Ha | F24F 1/16 62/159 |
| 2014/0165642 | A1* | 6/2014 | Asari | F25B 7/00 62/335 |
| 2014/0230477 | A1* | 8/2014 | Furui | F25B 5/04 62/238.6 |
| 2015/0176866 | A1* | 6/2015 | Takayama | F25B 5/04 62/140 |
| 2015/0191182 | A1* | 7/2015 | Abou Eid | B61D 27/0018 62/80 |
| 2015/0330675 | A1* | 11/2015 | Tamaki | F25B 13/00 62/324.1 |
| 2016/0320105 | A1* | 11/2016 | Okazaki | F25B 25/005 |
| 2016/0334143 | A1* | 11/2016 | Xie | F25B 7/00 |
| 2017/0030619 | A1* | 2/2017 | Kim | F25B 5/04 |
| 2017/0167758 | A1* | 6/2017 | Tsai | F25B 7/00 |
| 2018/0363947 | A1* | 12/2018 | Cosby, II | F24H 4/04 |
| 2019/0078821 | A1* | 3/2019 | Zhang | F25B 43/043 |

OTHER PUBLICATIONS

International Search Report and Written Opinion, International Patent Application No. PCT/US2016/012626, May 19, 2016 (8 pages).

* cited by examiner

HEAT PUMP

FIELD

The disclosure herein relates to a heat pump, such as for example may be used in a heating, venting and air conditioning (HVAC) system.

BACKGROUND

A heat pump generally refers to a reversible refrigeration circuit. The heat pump typically includes a compressor, a first heat exchanger (e.g. an indoor heat exchanger), a second heat exchanger (e.g. an outdoor heat exchanger), one or more expansion devices and a flow reversing device. In one working mode, e.g. a cooling operation mode, the first heat exchanger may receive two-phase refrigerant to provide cooling to, for example, an enclosed space or a process fluid, e.g. water. In another working mode, e.g. a heating operation mode, the first heat exchanger may receive hot compressed refrigerant to provide heating to, for example, the enclosed space or the process fluid. In some applications, the heat pump may also be connected to a hot water heat exchanger to provide utility hot water.

SUMMARY

A heat pump system including a main circuit and a capacity boost circuit is disclosed. The main circuit and the capacity boost circuit can form a heat exchange relationship so that a first refrigerant in the main circuit and a second refrigerant in the capacity boost circuit may exchange heat. The heat pump system may have a plurality of operation modes. Depending on the operation modes, the main circuit may receive heat from or transfer heat to the capacity boost system.

In some embodiments, when the heat pump is in operation, the capacity boost circuit may be configured to form a heat exchange relationship with the main circuit so as to exchange heat from the second refrigerant in the capacity boost circuit to the first refrigerant in the main circuit. In some embodiments, the capacity boost circuit may be configured to transfer heat to the main circuit when the heat pump is in a heating mode. In some embodiments, the capacity boost circuit may be configured to take heat away from the main circuit when the heat pump is in a cooling mode.

In some embodiments, the capacity boost circuit may include a heat exchanger configured to receive at least a portion of the compressed second refrigerant in the capacity boost circuit. The heat exchanger may be configured to receive at least a portion of the expanded first refrigerant from the main circuit, and the portion of the expanded first refrigerant and the portion of the compressed second refrigerant may form the heat exchange relationship in the heat exchanger.

In some embodiments, the capacity boost circuit may further include a hot water heat exchanger, which is configured to receive at least a portion of the compressed second refrigerant to transfer heat to a fluid (e.g. utility water) directed into the hot water heat exchanger.

In some embodiments, the main circuit further may include a thermal storage circuit configured to form a heat exchange relationship with the capacity boost circuit when the heat pump is operated in a thermal storage mode, and the capacity boost circuit may be configured to receive heat from a storage media in the thermal storage circuit.

The main circuit and the capacity boost circuit may employ different refrigerants, which may allow the main circuit and the capacity boost circuit to be optimized for different purposes (e.g. optimized for an operation modes and different operation conditions within an operation mode, and which can reduce potential environmental impact on the efficiency and performance of the refrigerant being used). In some embodiments, the first refrigerant may be a fluorinated gas (F-gas) type refrigerant, such as for example a HFO or HFC/HFO blend, and the like, and in some cases the first refrigerant may include R22, R134a, and/or R410A. In some embodiments, the first refrigerant includes other HFOs or HFC/HFO blends, where in some embodiments the first refrigerant is a type of low global warming potential (GWP) refrigerant. In some embodiments, the first refrigerant is R32, R1234yf, and/or R1234ze(E) and the like. In some embodiments, the second refrigerant may be R744 or $CO_2$ or comparable performing refrigerant or the like.

In some embodiments, a method of operating a heat pump system may include compressing a first refrigerant; condensing the first refrigerant; expanding the first refrigerant; compressing a second refrigerant; and transferring heat to the expanded first refrigerant by forming a heat exchange relationship between the expanded first refrigerant and the compressed second refrigerant.

Other features and aspects of the systems, methods, and control concepts will become apparent by consideration of the following detailed description and accompanying drawings.

BRIEF DESCRIPTION OF THE DRAWINGS

Reference is now made to the drawings in which like reference numbers represent corresponding parts throughout.

FIG. 1A illustrates that the heat pump is operated in a heating operation mode. FIG. 1B illustrates that the heat pump is operated in a cooling mode and/or water heating operation mode.

DETAILED DESCRIPTION

Figure 1A:
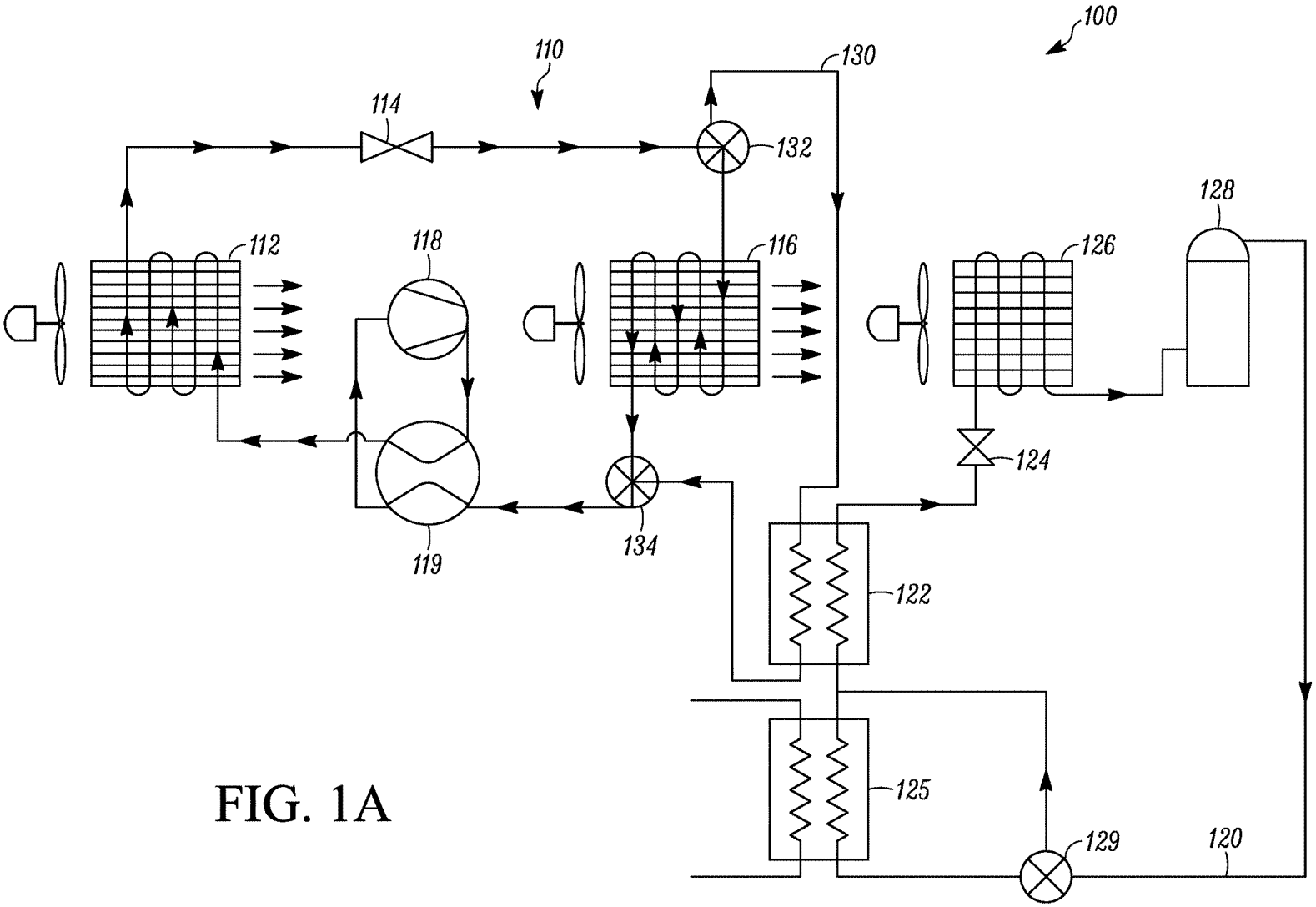
FIGS. 1A and 1B illustrate a heat pump system according to one embodiment.

A heat pump, such as for example may be used in a HVAC system, is a reversible vapor compression device and may be configured to provide cooling, heating, and thermal energy transfer (e.g. providing hot utility water) depending on an operation mode of the heat pump. Typically, the heat pump uses a single refrigerant, e.g. R22, R134a, R410A, as an intermediate fluid to absorb heat when the refrigerant vaporizes and then to release heat when the refrigerant condenses. A capacity and/or efficiency of the heat pump can vary depending on, for example, an ambient temperature, the operation mode, and/or the refrigerant used. Typically, the heat pump is configured to balance the capacity and/or efficiency in a range of environmental conditions, such as for example ambient temperatures, operation conditions, and/or the type of refrigerant used.

For example, a specific refrigerant may be chosen for optimizing the performance of the heat pump in a specific range of ambient temperatures. However, when a single refrigerant is used, it may be difficult to optimize the capacity and/or efficiency in both the cooling operation mode and the heating operation mode at all operation conditions due to the characteristic(s) of the refrigerant used (e.g. the critical temperature of the refrigerant). For example, the heat pump optimized for a cooling operation mode may suffer from loss of capacity and efficiency at a relatively low ambient temperature as compared to when it may be used in a heating operation mode. Conversely, the heat pump optimized with a refrigerant for a heating operation mode may suffer from loss of capacity and efficiency at a relatively high ambient temperature as compared to when it may be used in a cooling operation mode.

In some applications, for example, when the heat pump is operated in a relatively low ambient temperature (e.g. below 0 degrees Celsius) a ground source may be employed to supply enough heat to meet increasing heat demands at the relatively low ambient temperature, which can significantly increase the cost of providing heating.

Embodiments as disclosed herein are directed to a heat pump that employs at least two different refrigerants, each of which is optimized for either a cooling operation mode or a heating operation mode. In some embodiments, low temperature performance of the heat pump can be enhanced by employing R744 (carbon dioxide) as a refrigerant in a capacity boost circuit to a main circuit that may employ, for example, a fluorinated gas. The embodiments as disclosed herein can help increase the capacity and/or efficiency of the heat pump in both the cooling operation mode and the heating operation mode. In addition, the embodiments as disclosed herein may also eliminate the need for a ground source in a relatively low ambient temperature environment.

References are made to the accompanying drawings that form a part hereof, and in which is shown by way of illustration of the embodiments in which the embodiments may be practiced. It is to be understood that the terms used herein are for the purpose of describing the figures and embodiments and should not be regarded as limited in scope.

Figure 1B:
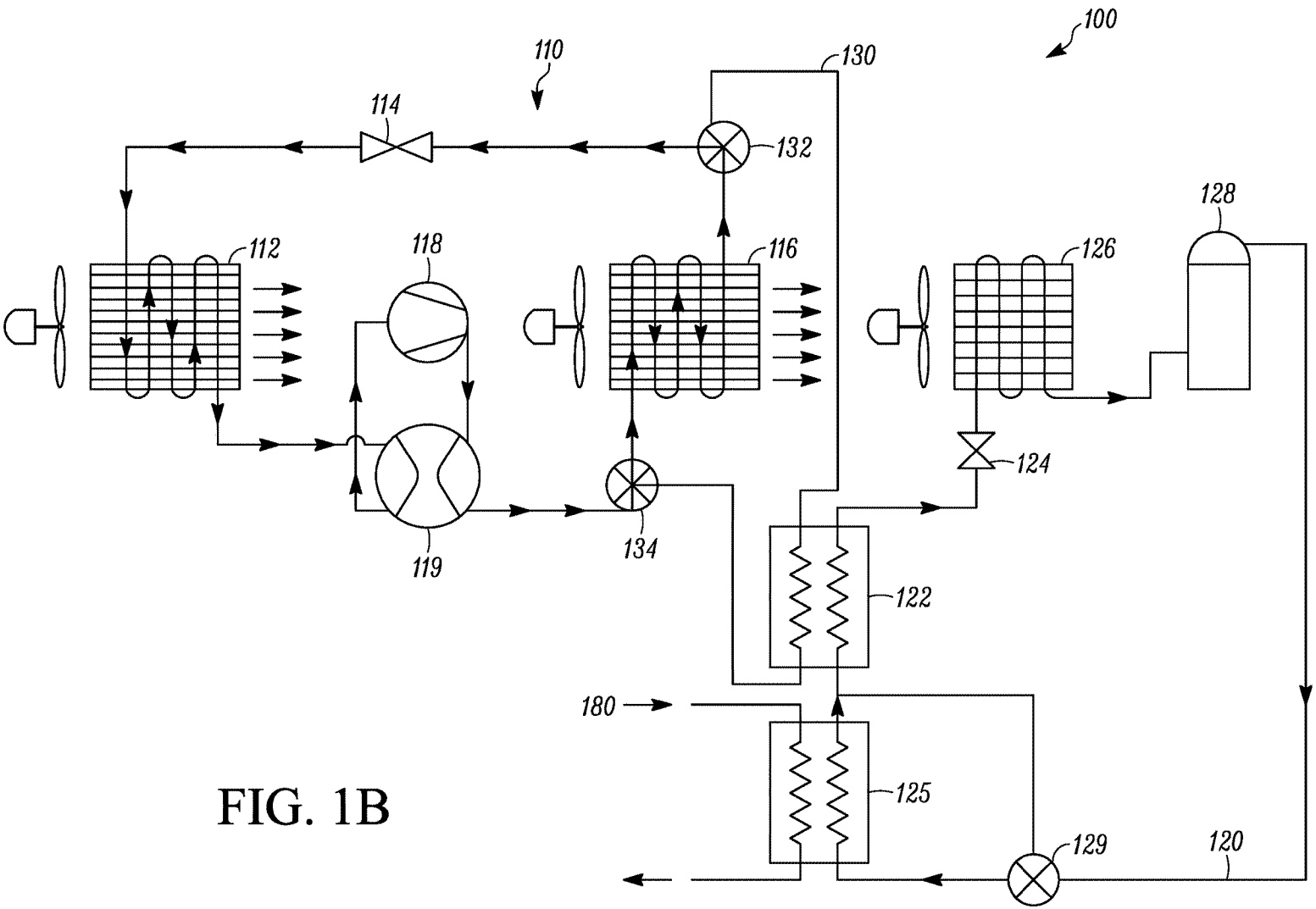

FIGS. 1A and 1B illustrate a heat pump system 100 that includes a first circuit 110 and a second circuit 120. The second circuit 120 is configured to increase a capacity and/or efficiency of the first circuit 110 in a heating operation mode when an ambient temperature is relatively low.

The first circuit 110 and the second circuit 120 are configured to form a refrigeration circuit independently. The first circuit 110 may include a first heat exchanger 112, an expansion device 114, a second heat exchanger 116, a flow reversing device 119 (e.g. a four way valve) and a compressor 118. The second circuit 120 may include a condenser 122, an expansion device 124, an evaporator 126 and a compressor 128.

The first circuit 110 functions as a main circuit configured to, for example, provide heating and/or cooling, such as for example to a building or an enclosed space. It is to be appreciated that the first circuit 110 can be configured to regulate a temperature of a process fluid (e.g. water) in some embodiments. The second circuit 120 can function as a capacity boost circuit configured, for example, to boost a capacity and/or efficiency of the first circuit 110.

The heat pump system 100 also includes a coupling circuit 130 that is configured to form a heat exchange relationship between the first circuit 110 and the second circuit 120. As illustrated, the coupling circuit 130 is connected to the first circuit 110 through a first flow regulating device (e.g. herein valve) 132 and a second flow regulating device (e.g. herein valve) 134. When the first valve 132 and the second valve 134 are in an open state, a first refrigerant from the first circuit 110 can be directed into the coupling circuit 130. In the coupling circuit 130, the first refrigerant from the first circuit 110 is directed into the condenser 122 of the second circuit 120 to form a heat exchange relation with a second refrigerant in the second circuit 120 so that, for example, heat can be transferred from the second refrigerant to the first refrigerant. In some embodiments, the condenser 122 is a part of the coupling circuit 130, along with the first and second valves 132, 134 and fluid lines, to form the heat exchange relationship of the first circuit 110 with the second circuit 120.

The coupling circuit 130 may be used when, for example, the first circuit 110 is in a heating operation mode and an ambient temperature is relatively low (where the first circuit may be susceptible to reduced capacity and/or efficiency depending on the type of refrigerant employed). In the illustrated embodiment, in the heating operation mode, the first heat exchanger 112, which functions as a condenser in the heating operation mode, receives compressed high temperature first refrigerant from the compressor 118 and releases heat from the first refrigerant. The first refrigerant is then expanded by the expansion device 114 to reduce the temperature. Generally, (e.g. when the first and second valves 132, 134 are in a closed state), the expanded first refrigerant is directed into the second heat exchanger 116, which functions as an evaporator in the heating operation mode, to absorb heat. The second heat exchanger 116 is typically exposed to an outdoor environment. When the ambient temperature is relatively low, the capacity and/or efficiency of the second heat exchanger 116 in some cases can be relatively low.

Referring to FIG. 1A, to boost the operation of the first circuit 110 in the heating operation mode, at least a portion of the first refrigerant is directed into the coupling circuit 130 by opening the valves 132, 134, where the first refrigerant can form a heat exchange relationship with the second refrigerant in the second circuit 120 via the condenser 122 of the second circuit 120.

In the second circuit 120, the condenser 122 receives the compressed second refrigerant from the compressor 128. The high temperature second refrigerant can exchange heat with the first refrigerant in the condenser 122 to vaporize the first refrigerant. Hence, the condenser 122 of the second circuit 120 functions as part of the coupling circuit 130 as an "evaporator" for the first circuit 110. The heat exchange efficiency in the condenser 122 may not be affected by the ambient temperature, because the condenser 122 is not exposed to the ambient temperature, e.g. the outdoors. The second circuit 120 can be configured to have a heat exchange capacity that is higher than the heat exchange capacity of the second heat exchanger 116 when the ambient temperature is relatively low. The capacity of the first circuit 110 therefore can be increased in the heating operation mode when the coupling circuit 130 is used to help a heat exchange relationship between the first circuit 110 and the second circuit 120.

When the ambient temperature is relatively high, the first and second valves 132, 134 can be closed, so that the first refrigerant is directed through the second heat exchanger 116. In such an example, it will be appreciated that the second circuit 120 may not be running in some cases (see e.g. FIG. 1B).

Referring to FIG. 1B, when the second circuit 120 is not needed for boosting the capacity of the first circuit 110, for example when the first circuit 110 is in a cooling operation mode as illustrated in FIG. 1B, the second circuit 120 may be optionally used, for example, to make utility hot water. The second circuit 120 may include a flow regulating device (e.g. by-pass valve) 129. The by-pass valve 129 can selectively direct at least a portion of the second refrigerant to a hot water heat exchanger 125. It is to be understood that the by-pass valve 129 can also configured to direct the second refrigerant directly into the evaporator 122, by-passing the hot water heat exchanger 125 (e.g. in the heating operation mode).

In operation, when the second circuit 120 is not needed for boosting the capacity of the first circuit 110, the by-pass valve 129 can direct at least a portion of the second refrigerant toward the hot water heat exchanger 125 to exchange heat with a process fluid 180 (e.g. utility water). The hot water heat exchanger 125 may function as an evaporator in this operation mode to have heat exchange with, e.g. evaporate, fluid flowing through the hot heat exchanger 125. When the second circuit 120 is needed for boosting the capacity of the first circuit 110, the by-pass valve 129 can direct the second refrigerant toward the heat exhanger 122 directly, by-passing the hot water heat exchanger 125 (as illustrated in FIG. 1A).

It is noted that the first and second refrigerants can be different. The main circuit and the capacity boost circuit may employ different refrigerants, which may allow the main circuit and the capacity boost circuit to be optimized for different purposes.

In some embodiments, the first refrigerant may be a fluorinated gas (F-gas) type refrigerant, such as for example a HFO or HFC/HFO blend, and the like, and in some cases the first refrigerant may include R22, R134a, and/or R410A or other fluorinated gas. In some embodiments, the first refrigerant includes other HFO or HFC/HFO blend, where in some embodiments the first refrigerant is a type of low global warming potential (GWP) refrigerant. In some embodiments, the first refrigerant has a GWP is 0-675, or in some embodiments it is 675 or less, or in some embodiments is 150 or less. In some embodiments, the first refrigerant is R32, R1234yf, and/or R1234ze(E) and the like. In some embodiments, the second refrigerant may be R744 or $CO_2$ or comparable performing refrigerant or the like. In some embodiments, the second refrigerant may have a higher critical point than the first refrigerant.

The second circuit 120 may be coupled to an existing system to boost the capacity of the existing system. In some embodiments, a refrigerant in the existing system may be replaced by another refrigerant (for example, a more environment friendly refrigerant e.g. a low GWP refrigerant). The refrigerant replacement may cause the capacity of the existing system to be comprised. The second circuit 120 can be employed to compensate the possible capacity loss due to refrigerant replacement to ensure the performance of the existing system after the refrigerant replacement.

The second circuit 120 can generally help optimize the performance of the first circuit 110 in both the heating operation mode and the cooling operation mode in a wide range of ambient temperatures. In some embodiments, the second circuit 120 can help optimize the performance when the first circuit 110 employs relatively low global warming potential (GWP) refrigerants (e.g. HFO, HFC refrigerants). The first circuit 110 can still be employed as an air cooled device, eliminating the need for a ground heat source. The second circuit 120 can be modular and can be installed depending on geographic climate and refrigerant options. For example, in some geographic climate (e.g. in a tropical region), the second circuit 120 may not be necessary. In some other geographic climate (e.g. in northern region), the second circuit 120 may be installed.

Figure 2:
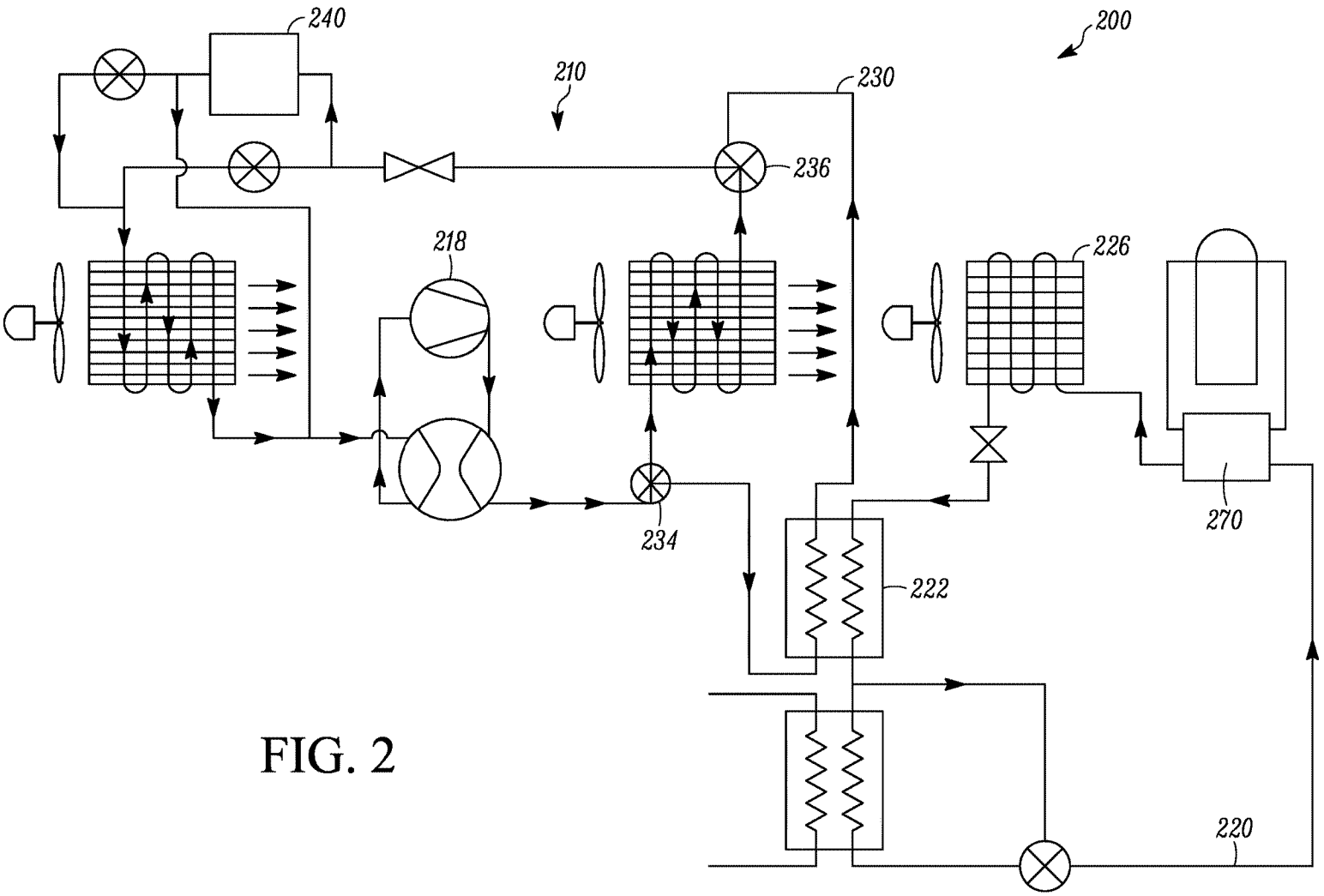
FIG. 2 illustrates a heat pump system according to another embodiment.

FIG. 2 illustrates another embodiment of a heat pump system 200, which includes a first circuit 210 and a second circuit 220 that are in a heat exchange relationship via a coupling circuit 230. The second circuit 220 includes a reversing device 270 (e.g. a four way valve) that enables the second circuit 210 to operate in a reversed operation mode with respect to the operation as illustrated in FIGS. 1A and 1B. It is to be understood that the second circuit 220 can operate in the similar operation mode as illustrated in FIGS. 1A and 1B by changing the reversing device 270. The heat pump system 200 can allow heat to be transferred from a first refrigerant in the first circuit 210 to a second refrigerant in the second circuit 220, and/or transferred from the second refrigerant to the first refrigerant, depending on, for example, an operation mode of the heat pump system 200.

In the illustrated operation in FIG. 2, the second circuit 220 can help boost the capacity of the first circuit 210 when the first circuit is operated in a cooling operation mode. As illustrated, a first heat exchanger 226 functions as a condenser that receives the compressed high temperature second refrigerant, and a second heat exchanger 222 functions as an evaporator that receives the relatively low temperature second refrigerant.

By opening flow regulating devices (e.g. valves) 234 and 236, at least a portion of the compressed high temperature first refrigerant from a compressor 218 may be delivered to the second heat exchanger 222 to exchange heat with the second refrigerant with the relatively low temperature. The heat exchange may help lower the temperature of the first refrigerant, boosting the capacity of the first circuit 210 in the cooling operation mode.

In some embodiments, the first circuit 210 may include a thermal storage circuit 240. The thermal storage circuit 240 can be used in a cold storage operation, where the thermal storage circuit 240 is generally configured to receive a relatively low temperature first refrigerant (e.g. the first refrigerant that is expanded by an expansion device) to, for example, lower a temperature of a thermal storage media (e.g. water). When the cooling demand is high, for example, the thermal storage media may be used to boost the capacity of the first circuit 210. The second circuit 220 can help boost the cooling capacity of the first circuit 210 during the cold storage operation. In some embodiments, the cold storage operation may be operated at a non-peak hour (e.g. non-peak electrical hours, such as at night). In some embodiments, the thermal storage circuit 240 includes additional valves, which may be closed for thermal storage charging or open for thermal storage use.

In some examples, such as in the cooling mode, FIG. 2 shows that the capacity boost circuit or second circuit 220 can be activated to be useful for example, where the first heat exchanger 226 is used to make hot water. In such cases, the refrigerant that may be sometimes employed is R744 in the second circuit 220. It will be appreciated that refrigerants other than R744 may be employed for example to augment the cooling operation.

Aspects

It will be appreciated that any one or more of aspects 1 to 6 may be combined with any one or more of aspects 7 to 22, aspect 7 may be combined with any one or more of aspects 8 to 22, aspect 8 may be combined with any one or more of aspects 9 to 22, any one or more of aspects 9 to 19 may be combined with any one or more of aspects 20-22, aspect 20 may be combined with any one or more of aspects 21 and 22, and aspect 21 may be combined with aspect 22.

Aspect 1. A heat pump system, comprising:

a main circuit including a first refrigerant; and a capacity boost circuit including a second refrigerant, the capacity boost circuit configured to form a heat exchange relationship with the main circuit when the heat pump system is in operation so as to transfer heat from the second refrigerant to the first refrigerant in the main circuit.

Aspect 2. The heat pump system of aspect 1, wherein the capacity boost circuit includes a heat exchanger configured to receive at least a portion of the compressed second refrigerant in the capacity boost circuit, the heat exchanger is configured to receive at least a portion of the expanded first refrigerant from the main circuit, and the portion of the expanded first refrigerant and the portion of the compressed second refrigerant form the heat exchange relationship in the heat exchanger.

Aspect 3. The heat pump system of aspects 1-2, wherein the capacity boost circuit further includes a hot water heat exchanger, which is configured to receive at least a portion of the compressed second refrigerant to transfer heat to a fluid directed into the hot water heat exchanger.

Aspect 4. The heat pump system of aspects 1-3, wherein the main circuit further includes a thermal storage circuit configured to form a heat exchange relationship with the capacity boost circuit, and the capacity boost circuit is configured to receive heat from a storage media in the thermal storage circuit.

Aspect 5. The heat pump system of aspects 1-4, wherein the first refrigerant is a low GWP refrigerant.

Aspect 6. The heat pump system of aspects 1-5, wherein the second refrigerant is R744.

Aspect 7. A method of operating a heat pump system, comprising:

compressing a first refrigerant;

condensing the first refrigerant;

expanding the first refrigerant;

compressing a second refrigerant; and transferring heat to the expanded first refrigerant by forming a heat exchange relationship between the first refrigerant and the compressed second refrigerant.

Aspect 8. A heat pump system, comprising:

a main circuit including a first refrigerant; and a capacity boost circuit including a second refrigerant, the capacity boost circuit configured to form a heat exchange relationship with the main circuit when the heat pump system is in a first operation mode so as to exchange heat from the second refrigerant to the first refrigerant in the main circuit.

Aspect 9. A heat pump system, comprising:

a first refrigeration circuit having a first refrigerant, the first refrigeration circuit including a compressor, a flow reversing device in fluid communication with the compressor, a first heat exchanger in fluid communication with the flow reversing device in a heating operation mode, an expansion device in fluid communication with the first heat exchanger in the heating operation mode, a second heat exchanger in communication with the expansion device in the heating operation mode, the second heat exchanger is in fluid communication with the flow reversing device in the heating operation mode to return the first refrigerant to the compressor, the second heat exchanger is in fluid communication with the flow reversing device in an operation mode different from the heating operation mode, the expansion device is in fluid communication with the second heat exchanger in the operation mode, the first heat exchanger is in fluid communication with the expansion device in the operation mode, the first heat exchanger is in fluid communication with the flow reversing device to return the first refrigerant to the compressor;

a second refrigeration circuit having a second refrigerant, the second refrigerant circuit including a compressor, a first heat exchanger in fluid communication with the compressor, an expansion device in fluid communication with the first heat exchanger, a second heat exchanger in fluid communication with the expansion device and in fluid communication with the compressor to return the second refrigerant to the compressor; and a capacity boost circuit that forms a heat exchange relationship between the first refrigerant and the second refrigerant, the capacity boost circuit is formed by a first flow regulating device in fluid communication with the second heat exchanger of the first refrigeration circuit, and which is in fluid communication with the first heat exchanger of the second refrigeration circuit, and a second flow regulating device in fluid communication with the first heat exchanger of the second refrigeration circuit, wherein, in the capacity boost circuit, the first refrigerant forms a heat exchange relationship with the second refrigerant through the first heat exchanger of the second refrigeration circuit to provide a capacity boost to the first refrigeration circuit through the heat exchange relationship of the first refrigerant and the second refrigerant.

Aspect 10. The heat pump system of aspect 9, wherein, in the capacity boost circuit, the first heat exchanger of the second refrigeration circuit is configured to receive at least a portion of the second refrigerant, the first heat exchanger of the second refrigeration circuit is configured to receive at least a portion of the first refrigerant, and the portion of the first refrigerant and the portion of the second refrigerant form the heat exchange relationship in the first heat exchanger of the second refrigeration circuit, the portion of the first refrigerant is either expanded or compressed refrigerant, and the portion of the second refrigerant is either compressed or expanded refrigerant.

Aspect 11. The heat pump system of aspect 9 or 10, further comprising a hot water heat exchanger in fluid communication with the first heat exchanger of the second refrigeration circuit, the hot water heat exchanger is configured to receive at least a portion of the second refrigerant compressed by the compressor of the second refrigeration circuit, to transfer heat from the second refrigerant to a fluid directed into the hot water heat exchanger, and to direct the portion of the second refrigerant to the first heat exchanger of the second refrigeration circuit.

Aspect 12. The heat pump system of aspect 11, further comprising a bypass valve in fluid communication with the compressor of the second refrigeration circuit and the hot water heat exchanger.

Aspect 13. The heat pump system of any one or more of aspects 9 to 12, further comprising a thermal storage circuit in fluid communication with the second heat exchanger of the first refrigeration circuit and in fluid communication with the first heat exchanger of the first refrigeration circuit, the thermal storage circuit is configured to receive a portion of the first refrigerant from the capacity boost circuit, where, in the capacity boost circuit, the portion of the first refrigerant is in heat exchange relationship with a portion of expanded refrigerant of the second refrigerant.

Aspect 14. The heat pump system of aspect 13, wherein the second refrigeration circuit includes a flow reversing device.

Aspect 15. The heat pump system of any one or more of aspects 9 to 14, wherein the first refrigerant is a HFC or HFC/HFO blend with a low global warming potential.

Aspect 16. The heat pump system of any one or more of aspects 9 to 15, wherein the second refrigerant is R744 or other refrigerant that has a higher critical temperature than the first refrigerant.

Aspect 17. The heat pump system of any one or more of aspects 9 to 16, wherein the first heat exchanger of the first refrigeration circuit is an indoor heat exchanger, and the second heat exchanger of the first refrigeration circuit is an outdoor heat exchanger.

Aspect 18. The heat pump system of any one or more of aspects 9 to 17, wherein the capacity boost circuit boosts the capacity of the first refrigerant in the heating operation mode of the first refrigeration circuit.

Aspect 19. The heat pump system of aspect 11, wherein the first and second flow regulating devices of the capacity boost circuit are closed in a cooling operation mode of the first refrigeration circuit.

Aspect 20. A method of operating a heat pump system, comprising:

in a first refrigeration circuit, compressing a first refrigerant;

condensing the first refrigerant;

expanding the first refrigerant;

in a second refrigeration circuit compressing a second refrigerant that is different from the first refrigerant; and transferring heat to a portion of the expanded first refrigerant by forming a heat exchange relationship between the expanded first refrigerant and the compressed second refrigerant, wherein the compressed second refrigerant boosts the capacity of the first refrigerant through the heat exchange relationship.

Aspect 21. A method of operating a heat pump system, comprising:

in a first refrigeration circuit, compressing a first refrigerant;

condensing the first refrigerant;

expanding the first refrigerant;

in a second refrigeration circuit compressing a second refrigerant that is different from the first refrigerant; and transferring heat to a portion of the condensed first refrigerant by forming a heat exchange relationship between the condensed first refrigerant and the compressed second refrigerant, wherein the compressed second refrigerant boosts the capacity of the first refrigerant through the heat exchange relationship.

Aspect 22. A method of boosting capacity of a main refrigeration circuit, comprising:

replacing a refrigerant in a first refrigeration circuit with a first refrigerant; and coupling the first refrigeration circuit to a second refrigeration circuit, the second refrigeration circuit has a second refrigerant different from the first refrigerant;

the coupling includes fluidly communicating the first refrigeration circuit with a capacity boost circuit having a heat exchanger, and fluidly communicating the second refrigeration circuit with the capacity boost circuit, forming a heat exchange relationship between the first refrigerant and the second refrigerant through the heat exchanger of the capacity boost circuit, wherein the second refrigerant is to boost the capacity of the first refrigerant during operation of the first refrigeration circuit.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. A method of boosting capacity of a main refrigeration circuit, comprising:

replacing a refrigerant in a first refrigeration circuit with a first refrigerant; and coupling the first refrigeration circuit to a second refrigeration circuit, the second refrigeration circuit has a second refrigerant different from the first refrigerant;

the coupling includes fluidly communicating the first refrigeration circuit with a capacity boost circuit having a heat exchanger using a flow director configured to distribute flow among a heat exchanger of the first refrigeration circuit and the capacity boost circuit, and fluidly communicating the second refrigeration circuit with the capacity boost circuit, forming a heat exchange relationship between the first refrigerant and the second refrigerant through the heat exchanger of the capacity boost circuit, operating the main refrigeration circuit in a heating mode, wherein heat is transferred to the first refrigerant by the second refrigerant to boost the capacity of the first refrigerant during operation of the first refrigeration circuit, and in the heating mode, the flow director receives fluid flow from an expansion device of the first refrigeration circuit and is downstream from the expansion device of the first refrigeration circuit, and operating the main refrigeration circuit outside the heating mode, wherein the second refrigerant is directed to a heat exchanger thermally coupled to one of a hot water heater or a thermal storage medium via a by-pass valve, the by-pass valve configured to selectively operate in a first mode when the second refrigeration circuit is in a heat exchange relationship with the first refrigeration circuit and a second mode when the second refrigeration circuit is not in the heat exchange relationship with the first refrigeration circuit, wherein in the first mode, the by-pass valve directs the second refrigerant to the heat exchanger of the capacity boost circuit, and in the second mode, the by-pass valve directs the second refrigerant to the heat exchanger thermally coupled to one of a hot water heater or a thermal storage medium.

2. The method of claim 1, wherein the first refrigerant is a HFC or HFC/HFO blend with a low global warming potential.

3. The method of claim 1, wherein the second refrigerant is R744 or other refrigerant that has a higher critical temperature than the first refrigerant.

4. A heat pump system, comprising:

a first refrigeration circuit having a first refrigerant, the first refrigeration circuit including a compressor, a flow reverser in fluid communication with the compressor, a first heat exchanger in fluid communication with the flow reverser in a heating operation mode, an expansion device in fluid communication with the first heat exchanger in the heating operation mode, a second heat exchanger in communication with the expansion device in the heating operation mode, the second heat exchanger is in fluid communication with the flow reverser in the heating operation mode to return the first refrigerant to the compressor, the second heat exchanger is in fluid communication with the flow reverser in an operation mode different from the heating operation mode, the expansion device is in fluid communication with the second heat exchanger in the operation mode, the first heat exchanger is in fluid communication with the expansion device in the operation mode, the first heat exchanger is in fluid communication with the flow reverser to return the first refrigerant to the compressor;

a second refrigeration circuit having a second refrigerant, the second refrigerant circuit including a compressor, a first heat exchanger in fluid communication with the compressor, an expansion device in fluid communication with the first heat exchanger, a second heat exchanger in fluid communication with the expansion device and in fluid communication with the compressor to return the second refrigerant to the compressor, a third heat exchanger in fluid communication with the first heat exchanger of the second refrigeration circuit, and a by-pass valve, the by-pass valve located between the compressor of the second refrigeration circuit and the first heat exchanger of the second refrigeration circuit, the by-pass valve configured to selectively operate in a first mode when the second refrigeration circuit is in a heat exchange relationship with the first refrigeration circuit and a second mode when the second refrigeration circuit is not in the heat exchange relationship with the first refrigeration circuit, wherein in the first mode, the by-pass valve directs the second refrigerant to the first heat exchanger of the second refrigeration circuit, and in the second mode, the by-pass valve directs the second refrigerant to the third heat exchanger of the second refrigeration circuit; and a capacity boost circuit that forms the heat exchange relationship between the first refrigerant and the second refrigerant, the capacity boost circuit is formed by a first flow director in fluid communication with the second heat exchanger of the first refrigeration circuit, and which is in fluid communication with the first heat exchanger of the second refrigeration circuit, and a second flow director in fluid communication with the first heat exchanger of the second refrigeration circuit, wherein, in the capacity boost circuit, the first refrigerant forms a heat exchange relationship with the second refrigerant through the first heat exchanger of the second refrigeration circuit to provide a capacity boost to the first refrigeration circuit through the heat exchange relationship of the first refrigerant and the second refrigerant, wherein the first and second flow directors each have an open position allowing a flow of fluid into the capacity boost circuit and a closed position, wherein the first flow director is configured to distribute flow among the second heat exchanger of the first refrigeration circuit and the capacity boost circuit, and, in the heating operation mode, the first flow director receives the first refrigerant from the expansion device and is downstream of the expansion device.

5. The heat pump system of claim 4, wherein the first refrigerant is a HFC or HFC/HFO blend with a low global warming potential.

6. The heat pump system of claim 4, wherein the second refrigerant is R744 or other refrigerant that has a higher critical temperature than the first refrigerant.

7. The heat pump system of claim 4, wherein the first heat exchanger of the first refrigeration circuit is an indoor heat exchanger, and the second heat exchanger of the first refrigeration circuit is an outdoor heat exchanger.

8. The heat pump system of claim 4, wherein the capacity boost circuit boosts the capacity of the first refrigerant in the heating operation mode of the first refrigeration circuit.

9. The heat pump system of claim 4, wherein the third heat exchanger of the second refrigeration circuit is a hot water heat exchanger.

10. The heat pump system of claim 9, wherein the first and second flow directors of the capacity boost circuit are closed in a cooling operation mode of the first refrigeration circuit.

11. The heat pump system of claim 4, wherein the third heat exchanger of the second refrigeration circuit is a heat exchanger of a thermal storage circuit.

12. The heat pump system of claim 11, wherein the second refrigeration circuit includes a flow reverser.

13. The heat pump system of claim 4, wherein, in the capacity boost circuit, the first heat exchanger of the second refrigeration circuit is configured to receive at least a portion of the second refrigerant, the first heat exchanger of the second refrigeration circuit is configured to receive at least a portion of the first refrigerant, and the portion of the first refrigerant and the portion of the second refrigerant form the heat exchange relationship in the first heat exchanger of the second refrigeration circuit, the portion of the first refrigerant is either expanded or compressed refrigerant, and the portion of the second refrigerant is either compressed or expanded refrigerant.

* * * * *